US005595302A

United States Patent [19]

Maydwell et al.

[11] Patent Number: 5,595,302

[45] Date of Patent: Jan. 21, 1997

[54] LUNCHBOX

[76] Inventors: Jude D. Maydwell; Kathleen Maydwell, both of 73 E. Franklin St., Ephrata, Pa. 17522-2446

[21] Appl. No.: 586,030

[22] Filed: Jan. 16, 1996

[51] Int. Cl.[6] ..... A45C 11/20

[52] U.S. Cl. ..... 206/541; 206/549; 206/579; 206/224; 220/522; 190/109

[58] Field of Search ..... 206/541, 217, 206/223, 542, 579, 224, 63.5, 581, 549, 214; 220/522; 190/109, 110

[56] References Cited

U.S. PATENT DOCUMENTS

| | | | |
|---|---|---|---|
| 1,458,679 | 6/1923 | Bishop | 206/541 |
| 2,397,225 | 3/1946 | Walters | 206/541 |
| 2,672,232 | 3/1954 | Kessel, Jr. | 220/522 |
| 4,591,056 | 5/1986 | Groch | 206/214 |
| 4,648,512 | 3/1987 | Tarozzi et al. | 206/541 |
| 4,666,042 | 5/1987 | Dlott et al. | 206/542 |
| 5,025,928 | 6/1991 | Orosy et al. | 206/581 |
| 5,181,612 | 1/1993 | Liu | 206/542 |
| 5,447,215 | 9/1995 | Volkmar et al. | 190/109 |

*Primary Examiner*—Paul T. Sewell
*Assistant Examiner*—Luan K. Bui
*Attorney, Agent, or Firm*—Terry M. Gernstein

[57] ABSTRACT

A lunchbox contains a multiplicity of compartments, some of which can contain items necessary to brush one's teeth. The lunchbox contains a compartment for storing a toothbrush in a closed compartment, a compartment for storing toothpaste and a compartment for storing a cup. The lunchbox also contains pockets for games and drawing equipment which makes the lunchbox attractive to a schoolchild.

14 Claims, 2 Drawing Sheets

LUNCHBOX

TECHNICAL FIELD OF THE INVENTION

The present invention relates to the general art of containers, and to the particular field of lunchboxes.

BACKGROUND OF THE INVENTION

The benefits of proper dental hygiene are well documented. Proper dental hygiene has been shown to prevent gum disease, tooth decay and numerous other oral problems. Therefore, it is imperative for everyone to practice good dental hygiene. Good dental hygiene often includes brushing one's teeth after each meal.

It has also been well documented that if good dental hygiene habits are acquired in early childhood, these habits have great benefits later in life. Therefore, it is important to teach children good dental hygiene as early in life as possible.

However, many children carry their lunch to school, and often fail to brush their teeth after eating lunch. Therefore, there is a need to encourage proper dental hygiene in children, especially the habit of brushing their teeth after each meal. This includes brushing after lunch.

Therefore, there is a need for a means that can encourage school children to brush their teeth after eating, especially after eating lunch.

OBJECTS OF THE INVENTION

It is a main object of the present invention to provide a means for developing proper dental hygiene habits.

It is another object of the present invention to provide a means for encouraging children to brush their teeth after each meal.

SUMMARY OF THE INVENTION

These, and other, objects are achieved by a lunchbox that encourages children to carry toothpaste and a toothbrush with them to school.

The lunchbox of the present invention has a multiplicity of compartments, some of which can be used to carry and store games and game equipment, as well as drawing equipment. However, some of the compartments include means for storing toothbrushing equipment, including a toothbrush, toothpaste and a cup.

In this manner, the lunchbox encourages children to carry it, and, since it contains the items necessary to proper toothbrushing, it thereby encourages children to have the implements necessary to practice proper dental hygiene.

BRIEF DESCRIPTION OF THE DRAWING FIGURES

DETAILED DESCRIPTION OF THE PREFERRED EMBODIMENT OF THE INVENTION

Figure 1:
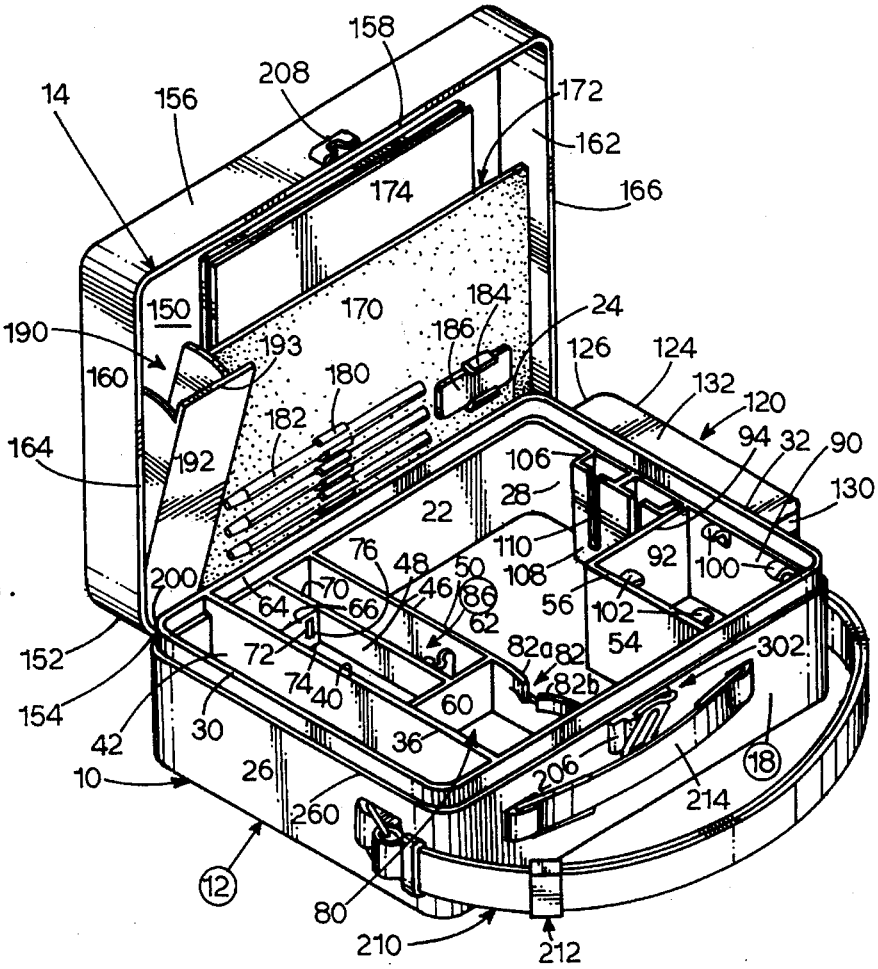
FIG. 1 is a top, front and side perspective view of the lunchbox embodying the present invention in the open condition.
Figure 2:
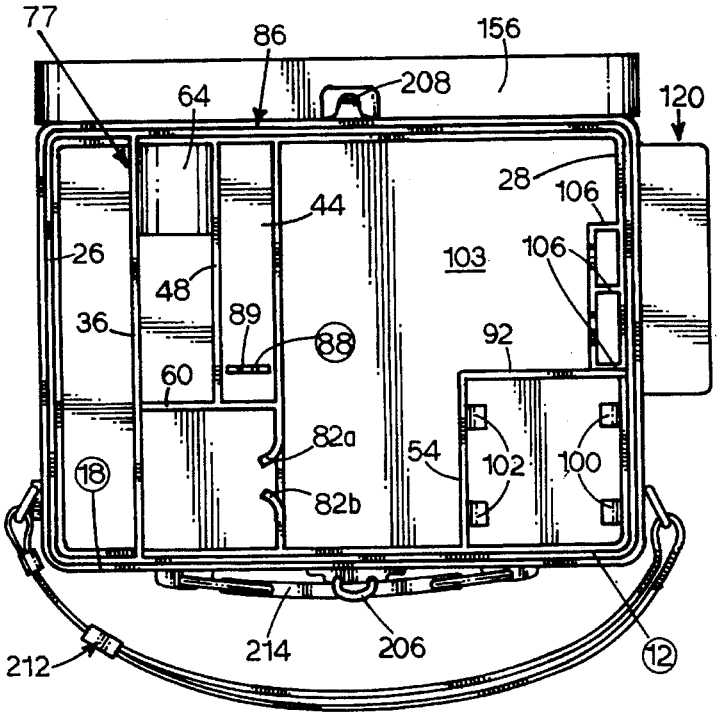
FIG. 2 is a top plan view of the lunchbox.

Shown in FIGS. 1 and 2 is a lunchbox 10 which has several functions all of which are pleasing to children, and at least one of which encourages proper dental hygiene, including brushing after meals. Lunchbox 10 comprises a bottom unit 12 and a top unit 14.

As shown in FIG. 1 bottom unit 12 includes a bottom plate 16 which is planar, a front wall 18 fixed to bottom plate 16 and having a top rim 20 spaced from bottom plate 16. Bottom unit 12 further includes a rear wall 22 fixed to bottom plate 16 and having a top rim 24 spaced from the bottom plate. First and second side walls 26 and 28 are each fixed to bottom plate 16 and each has a top rim 30 and 32 respectively, spaced from bottom plate 16. As shown in FIG. 1, all of the top rims are co-planar with each other in a first plane.

The bottom unit includes a longitudinal dimension extending from front wall 18 to rear wall 22 and a transverse dimension extending from first side wall 26 to said second side wall 28. These dimensions define the length and width of the bottom unit respectively.

Bottom unit 12 further includes a first longitudinal inner wall 36 fixed to bottom plate 16 and having a top rim 40 which is spaced from the bottom plate and which is co-planar with the first plane. Inner wall 36 extends parallel to the longitudinal dimension adjacent to first side wall 26. As seen in FIG. 1, first longitudinal inner wall 36 defining with first side wall 26, bottom plate 16, front wall 18 and rear wall 22 a first compartment 42.

Bottom unit 12 further includes a second longitudinal inner wall 44 fixed to bottom plate 16 and being spaced from first longitudinal inner wall 36. Wall 44 extends from rear wall 22 to front wall 18 and has a top rim 46 which is spaced from bottom plate 16 and which is located in a second plane spaced from the first plane.

A third longitudinal inner wall 48 is fixed to bottom plate 16 and has a top rim 50 spaced from bottom plate 16 and which is located in the second plane. Wall 48 is located between first longitudinal inner wall 36 and second longitudinal inner wall 44 and extends from rear wall 22 towards front wall 18.

Bottom unit 12 further includes a fourth longitudinal inner wall 54 fixed to bottom plate 16 and has a top rim 56 located in the second plane. The wall 54 extends from front wall 18 towards rear wall 22. fourth longitudinal inner wall 54 is spaced from second side wall 28 a distance equal to the spacing between third longitudinal inner wall 48 and first side wall 26 for uniformity of manufacture as will be understood from the present disclosure.

A first transverse inner wall 60 is fixed to bottom plate 16 and has a top rim 62 located in the second plane and extends between first and second longitudinal inner walls 36 and 44, and intersects a top edge of third longitudinal inner wall 48.

A cover plate 64 abuts rear wall 22, as well as first and third longitudinal inner walls 36 and 44 respectively. Cover plate 64 has a top surface which is co-planar with the second plane, and has an inner edge 66 spaced from rear wall 22 as well as from first transverse inner wall 60 and from bottom plate 16. The cover plate serves a purpose that will be understood from the following disclosure.

A hinge means 70 connects cover plate 64 to third longitudinal inner wall 48 whereby the cover plate moves between an open position extending at an angle out of the second plane as shown in dotted lines, and a closed position in the second plane as shown in full lines. A closure plate 72 is fixed to cover plate 64 and has a lower edge 74 which abuts bottom plate 16 when cover plate 64 is in said closed position as shown in full lines in FIG. 1. A slot 76 is defined in closure plate 72. Closure plate 72, cover plate 64, bottom plate 16, first longitudinal inner wall 36 and third longitudinal inner wall 48 combine to form a closed chamber 77 when cover plate 64 is in the closed position. As is also shown in FIG. 1, second longitudinal inner wall 44, front wall 18, bottom plate 16 and first transverse inner wall 60 combine to define a cup compartment 80. A first clip element 82 is located in second longitudinal inner wall 44 and includes two elements 82*a* and 82*b* extending toward first side wall 26 into cup compartment 80. Second and third longitudinal inner walls 44 and 48, bottom plate 16 and first transverse inner wall 60 combine with each other and with rear wall 22 to define a toothpaste tube compartment 86. A first support bracket 88 is fixed to bottom plate 16 in toothpaste tube compartment 86 and has a notch 89 defined therein for a purpose that will be understood from the following disclosure.

A juice container compartment 90 is defined by fourth longitudinal inner wall 54, bottom plate 16, front wall 18 and second transverse inner wall 92 which is fixed to bottom plate 16 and has a top rim 94 spaced from bottom plate 16 and located in the second plane. Second clip elements 100 are located on second side wall 28 and elements 102 are located on fourth longitudinal inner wall 54. Elements 100 and 102 extend into juice container compartment 90. As can also be seen in FIG. 1, walls 18, 54, 92, 108, 28, 22, 16 and 44 combine to define a lunch compartment 103 in which a child keeps sandwiches and the like. Change and keys can be stored in a change compartment defined between wall 108 and wall 28.

The bottom unit further includes support walls, such as support wall 106, fixed to second side wall 28 and which extend toward first side wall 26. Walls 106 are located adjacent to second transverse inner wall 92. A fifth longitudinal inner wall 108 is mounted on support walls 106 to be spaced from the second side wall. Slots, such as slot 110, are defined in fifth longitudinal inner wall 108.

A pencil case 120 is mounted on second side wall 28 and has a bottom wall fixed to second side wall 28, an outer side wall 124, a rear end wall 126, a front end wall 130 and a top wall 132. One of the walls of the pencil case is hingeably connected to the other walls whereby the case can be opened and closed to store items, such as pencils or the like.

Top unit 14 stores games and the like and includes a top plate 150, a rear wall 152 mounted on top plate 150 and having a bottom rim 154 spaced from top plate 150. Top unit 14 further includes a front wall 156 mounted on top plate 150 and having a bottom rim 158 spaced from top plate 150. First and second side walls 160 and 162, are mounted on top plate 150 and each has a bottom rim 164 and 166 respectively spaced from top plate 150 and connect the front wall 156 of the top unit to the rear wall 152 of the top unit. The bottom rims of top unit are co-planar with each other in a bottom plane.

The top unit further includes an inner wall 170 connected to second side wall 162 and is spaced from top plate 150 to define a pocket 172 for storing game boards, such as game board 174. A first spring clip means 180 is mounted on inner wall 170 of the top unit for releasably holding pencil-like elements, such as pencil 182. A second spring clip means 184 is mounted on inner wall 170 of the top unit for releasably holding eraser-like elements, such as eraser 186 on the inner wall 170.

Top unit 14 further includes a movable game pocket 190 which includes an outer wall 192 having a top edge 193 and is hingeably connected to bottom wall 152 by a hinge to move between an open position at an angle to the top plate and a closed position parallel to the top plate. The game pocket further includes two wings 194 each connected to outer wall 192 of the game pocket. As shown in FIG. 1, each of the wings 194 has a top edge 195 spaced from top edge 193 of outer wall 192 of the container pocket 190. Game pocket 190 permits storing dice and other game pieces in a convenient location in the lunchbox. Game pocket 190 is shown open in FIG. 1 and closed in FIG. 2.

A hinge means 200 movably connects top unit 14 to bottom unit 12 to move the top unit between an open position with front wall 156 of the top unit spaced from front wall 18 of the bottom unit and a closed position with bottom rim 158 of the front wall 156 of the top unit abutting the top rim 20 of the front wall 18 of the bottom unit.

A lock means 202 locks top unit 14 to bottom unit 12 when the top unit is in the closed position and includes a first element 206 on the bottom unit and a second element 208 on the top unit.

A handle means 210 is mounted on bottom unit 12 for carrying the lunchbox. The handle means 210 also includes a means 212 for adjusting the length of the handle means whereby the lunchbox can be carried over the shoulder as well as by hand. A second handle 214 is mounted on front wall 18 and is used to carry the lunchbox by hand.

Figure 3:
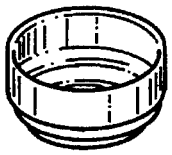
FIG. 3 is a perspective view of a collapsible cup in the collapsed condition.
Figure 6:
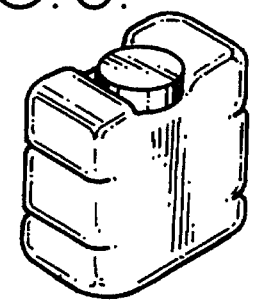
FIG. 6 is a perspective view of a juice container that can be used in the lunchbox of the present invention.

Referring to FIGS. 1, 2 and 6, it is seen that a juice container 220 can be carried in the lunchbox. Juice container 220 is accommodated in juice container compartment 90 and is held in place by spring clip elements 100 and 102. Referring to FIGS. 1, 2 and 3, it can be seen that lunchbox 10 also includes a collapsible cup 230 that is sized to fit into cup compartment 80 and will be held in place by clip element 82. As can be seen in FIG. 3, collapsible cup 230 includes a plurality of sections, such as section 232 and elongates longitudinally from the collapsed condition shown in FIG. 3 into a drinking cup as will be understood by those skilled in the art based on the teaching of this disclosure.

Figure 4:
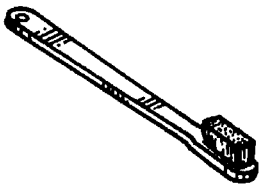
FIG. 4 is a perspective view of a toothbrush that can be used in the lunchbox of the present invention.

As is shown in FIGS. 1, 2 and 4, lunchbox 10 further includes a toothbrush 240 having a head 242 sized to fit into the closed chamber defined beneath cover plate 64. Toothbrush 240 includes a handle 244 sized to extend through slot 76 defined in closure plate 72. In this manner, the toothbrush is conveniently stored in a clean location.

Figure 5:
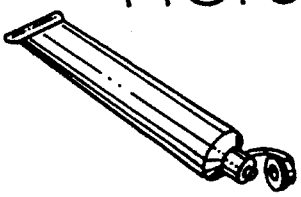
FIG. 5 is a perspective view of a toothpaste tube that can be used in the lunchbox of the present invention.

As is shown in FIGS. 1, 2 and 5, lunchbox 10 further includes a toothpaste tube 250 sized to fit into toothpaste tube compartment 86. Toothpaste tube 250 includes a neck 252 which is sized to fit into notch 88 to hold the toothpaste tube in position in the compartment 86. A flip-top cap 254 can also be included. The toothpaste is thus securely held in a convenient location in the lunchbox.

As is shown in FIG. 1, lunchbox 10 includes a shoulder 260 on side walls 26 and 28 of bottom unit 12 and on front wall 18 of the bottom unit. shoulder 260 is located in a shoulder plane which is spaced from the first plane and is located to be abutted by the bottom rim of top unit 14 when the lunchbox is closed.

It is understood that while certain forms of the present invention have been illustrated and described herein, it is not to be limited to the specific forms or arrangements of parts described and shown.

We claim:

1. A lunchbox comprising:

A) a bottom unit which includes (1) a bottom plate, (2) a front wall fixed to said bottom plate and having a top rim spaced from said bottom plate, (3) a rear wall fixed to said bottom plate and having a top rim spaced from said bottom plate, (4) first and second side walls, each being fixed to said bottom plate and each having a top rim spaced from said bottom plate, (5) all of said top rims being co-planar with each other in a first plane, (6) a longitudinal dimension extending from said front wall to said rear wall, (7) a transverse dimension extending from said first side wall to said second side wall, (8) a first longitudinal inner wall fixed to said bottom plate and having a top rim which is spaced from said bottom plate and which is co-planar with said first plane, and extending parallel to said longitudinal dimension adjacent to said first side wall, said first longitudinal inner wall defining with said first side wall, said bottom plate, said front wall and said rear wall a first compartment, (9) a second longitudinal inner wall fixed to said bottom plate, said second longitudinal inner wall being spaced from said first longitudinal inner wall and extending from said rear wall to said front wall and having a top rim which is spaced from said bottom plate and which is located in a second plane spaced from said first plane,

(10) a third longitudinal inner wall fixed to said bottom plate and having a top rim spaced from said bottom plate and located in said second plane, said third longitudinal inner wall being located between said first longitudinal inner wall and said second longitudinal inner wall and extending from said rear wall,

(11) a fourth longitudinal inner wall fixed to said bottom plate and having a top rim located in said second plane and extending from said front wall,

(12) said fourth longitudinal inner wall being spaced from said second side wall a distance equal to the spacing between said third longitudinal inner wall and said first side wall,

(13) a first transverse inner wall fixed to said bottom plate and having a top rim located in said second plane and extending between said first and second longitudinal inner walls and intersecting a top edge of said third longitudinal inner wall, and a second transverse inner wall fixed to said bottom plate and having a top rim located in said second plane,

(14) a cover plate abutting said rear wall and said first and third longitudinal inner walls and having a top surface which is co-planar with said second plane, and an inner edge spaced from said rear wall and from said first transverse inner wall and from said bottom plate,

(15) a hinge means for connecting said cover plate to said third longitudinal inner wall whereby said cover plate moves between an open position extending at an angle out of said second plane and a closed position in said second plane,

(16) a closure plate fixed to said cover plate and having a lower edge, said lower edge abutting said bottom plate when said cover plate is in said closed position,

(17) a slot defined in said closure plate,

(18) said closure plate, said cover plate, said bottom plate and said first and third longitudinal inner walls forming a closed chamber when said cover plate is in said closed position,

(19) said second longitudinal inner wall, said front wall, said bottom plate and said first transverse inner wall defining a cup compartment,

(20) a first clip element in said second longitudinal inner wall and including two elements extending toward said first side wall into said cup compartment,

(21) said second and third longitudinal inner walls, said bottom plate and said first transverse inner wall and said rear wall defining a toothpaste tube compartment,

(22) a first support bracket fixed to said bottom plate in said toothpaste tube compartment and having a notch defined therein,

(23) said fourth longitudinal inner wall, said bottom plate, said front wall and said second transverse inner wall defining a juice container compartment,

(24) second clip elements on said second side wall and on said fourth longitudinal inner wall and extending into said juice container compartment,

(25) support walls fixed to said second side wall and extending toward said first side wall adjacent to said second transverse inner wall,

(26) a fifth longitudinal inner wall mounted on said support walls to be spaced from said second side wall, said fifth longitudinal inner wall having a slot defined therein, and

(27) a pencil case mounted on said second side wall and having a bottom wall fixed to said second side wall, an outer side wall, a rear end wall, a front end wall and a top wall;

B) a top unit which includes (1) a top plate, (2) a rear wall mounted on said top plate and having a bottom rim spaced from said top plate, (3) a front wall mounted on said top plate and having a bottom rim spaced from said top plate, (4) first and second side walls, each mounted on said top plate and each having a bottom rim spaced from said top plate and each connecting the front wall of said top unit to the rear wall of said top unit, (5) the bottom rims of said top unit being co-planar with each other in a bottom plane, (6) an inner wall connected to said second side wall of the top unit and spaced from said top plate to define a pocket, (7) first spring clip means on said inner wall of the top unit for holding pencil-like elements, (8) second spring clip means on said inner wall of the top unit for holding eraser-like elements, and (9) a movable game pocket which includes (a) an outer wall having a top edge, (b) hinge means for connecting said outer wall of said movable game pocket to said rear wall of the top unit to move between an open position at an angle to said top plate and a closed position parallel to said top plate, and (c) two wings each connected to said outer wall of the game pocket;

C) hinge means for movably connecting said top unit to said bottom unit to move said top unit between an open position with said front wall of the top unit spaced from said front wall of the bottom unit and a closed position with said bottom rim of the front wall of the top unit abutting the top rim of the front wall of the bottom unit;

D) a lock means for locking said top unit to said bottom unit when said top unit is in said closed position; and E) handle means on said bottom unit for carrying top and bottom units.

2. The lunchbox defined in claim 1 wherein said lock means includes a first element on said bottom unit and a second element on said top unit.

3. The lunchbox defined in claim 2 wherein said handle means further includes a second handle mounted on the front wall of said bottom unit.

4. The lunchbox defined in claim 1 wherein said handle means further includes means for adjusting size.

5. The lunchbox defined in claim 1 further including a juice container sized to fit in said juice container compartment.

6. The lunchbox defined in claim 5 further including a collapsible cup sized to fit into said cup compartment.

7. The lunchbox defined in claim 6 further including a toothbrush having a head sized to fit into said closed chamber and a handle sized to extend through the slot defined in said closure plate.

8. The lunchbox defined in claim 7 further including a toothpaste tube sized to fit into said toothpaste tube compartment.

9. The lunchbox defined in claim 8 wherein said toothpaste tube includes a neck that is sized to fit into said notch.

10. The lunchbox defined in claim 1 further including a second slot defined in said fifth longitudinal inner wall and a second support wall located between said slot and said second slot.

11. The lunchbox defined in claim 1 wherein said wings have top edges spaced from the top edge of said outer wall of the container pocket.

12. The lunchbox defined in claim 1 wherein said top unit includes a longitudinal dimension extending between the front wall of said top unit and the rear wall of the top unit and a transverse dimension extending between the side walls of the top unit, the longitudinal dimension of said top unit being greater than the longitudinal dimension of said bottom unit and the transverse dimension of said top unit being greater than the transverse dimension of the bottom unit.

13. The lunchbox defined in claim 12 further including a shoulder on said side walls of the bottom unit and on said front wall of the bottom unit, said shoulder being located in a shoulder plane which is spaced from said first plane.

14. The lunchbox defined in claim 1 further including a plurality of game boards located in said game pocket.

* * * * *